US005979274A

United States Patent [19]

Hsieh

[11] Patent Number: 5,979,274

[45] Date of Patent: Nov. 9, 1999

[54] RATCHET WHEEL MOUNTING ARRANGEMENT OF A WRENCH

[76] Inventor: Chih-Ching Hsieh, No. 64, Lane 107, Liang Tsun Rd., Fong Yuan City, Taichung Hsien, Taiwan

[21] Appl. No.: 09/003,802

[22] Filed: Jan. 7, 1998

[51] Int. Cl.[6] ..... B25B 13/46; B25B 13/00

[52] U.S. Cl. ..... 81/60; 81/125.1

[58] Field of Search ..... 81/60, 125.1

[56] References Cited

U.S. PATENT DOCUMENTS 5,533,427 7/1996 Chow ..... 81/63.2

5,636,557 6/1997 Ma ..... 81/60

*Primary Examiner*—David A. Scherbel

*Assistant Examiner*—Philip J. Hoffmann

*Attorney, Agent, or Firm*—Varndell & Varndell, PLLC

[57] ABSTRACT

A ratchet wheel mounting arrangement in which a toothed arch block is mounted in a smoothly arched notch disposed inside a box end of a ratchet wrench. A smoothly arched notch extends axially to the topmost edge of the box end. The toothed arch block has one end disposed in contact with the arched notch. The other end of the arch block is supported on a spring in a blind hole in the arched notch. A toothed front side forced by the spring force into engagement with the ratchet wheel in the box end. The height of teeth of the toothed arch block is approximately equal to the height of teeth on the ratchet wheel.

1 Claim, 9 Drawing Sheets

RATCHET WHEEL MOUNTING ARRANGEMENT OF A WRENCH

BACKGROUND AND SUMMARY OF THE INVENTION

The present invention relates to a ratchet socket wrench, and more particularly, to an improved wheel mounting arrangement of a ratchet socket wrench which is easy to manufacture, and can be rapidly installed.

A variety of ratchet socket wrenches for turning hexagon head bolts and hexagon nuts has appeared on the market. FIGS. 1 to 3 show a ratchet wheel mounting arrangement of a ratchet socket wrench according to the prior art, wherein a ratchet wheel is mounted within a box end at one end of the wrench and secured in place by a C-shaped clamp and a cover plate. A spring is mounted in the box end. A toothed arch block is mounted within the box end is and forced by the spring into engagement with the ratchet wheel to limit rotary motion of the ratchet wheel inside the box end to one direction. The ratchet wheel has an annular groove around the periphery, and a plurality of teeth equiangularly spaced around the annular groove. The toothed arch block is mounted in a recessed hole inside the box end of the wrench, having a projecting rod raised from a back side thereof. The spring is mounted inside the recessed hole in the box end of the wrench and connected between the projecting rod of the toothed arch block and inside wall of the recessed hole. Because the teeth of the ratchet wheel are formed at the annular groove around the periphery (see FIGS. 16 to 18), the fabrication process of the ratchet wheel is complicated. The processing process of the recessed hole in the box end of the wrench is also complicated (see FIG. 11). Furthermore, the tooth arch block tends to be forced away from the spring. FIGS. 5 and 6 show another ratchet wheel mounting arrangement according to the prior art. This arrangement has the same drawbacks.

The present invention has been accomplished to provide a ratchet wheel mounting arrangement for a ratchet socket wrench which eliminates the aforesaid drawbacks. According to one aspect of the present invention, the box end of the wrench has a smoothly arched notch axially extended to the topmost edge of the inside wall thereof for receiving the toothed arch block, and a blind hole in the smoothly arched notch for receiving the spring, permitting the toothed arch block to be forced by the spring into positive engagement with the ratchet wheel. According to another aspect of the present invention, the teeth of the ratchet wheel are arranged around the peripheral wall thereof, and the height of teeth on the toothed front side of the toothed arch block is approximately equal to that of the teeth on the ratchet wheel.

DETAILED DESCRIPTION OF THE PREFERRED EMBODIMENT

Figure 1:
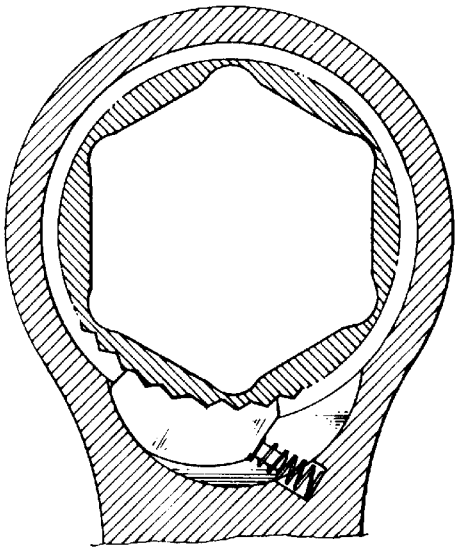
Fig. 1 PRIOR ART
FIG. 1 is a top view in section of a ratchet wheel mounting arrangement of a ratchet socket wrench according to the prior art.
Figure 2:
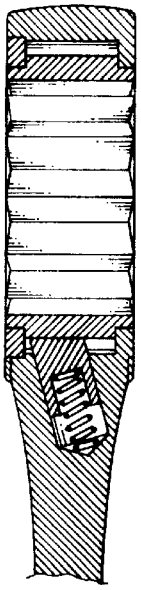
Fig. 2 PRIOR ART
FIG. 2 is a side view in section of the ratchet wheel mounting arrangement shown in FIG. 1.
Figures 3, 4:
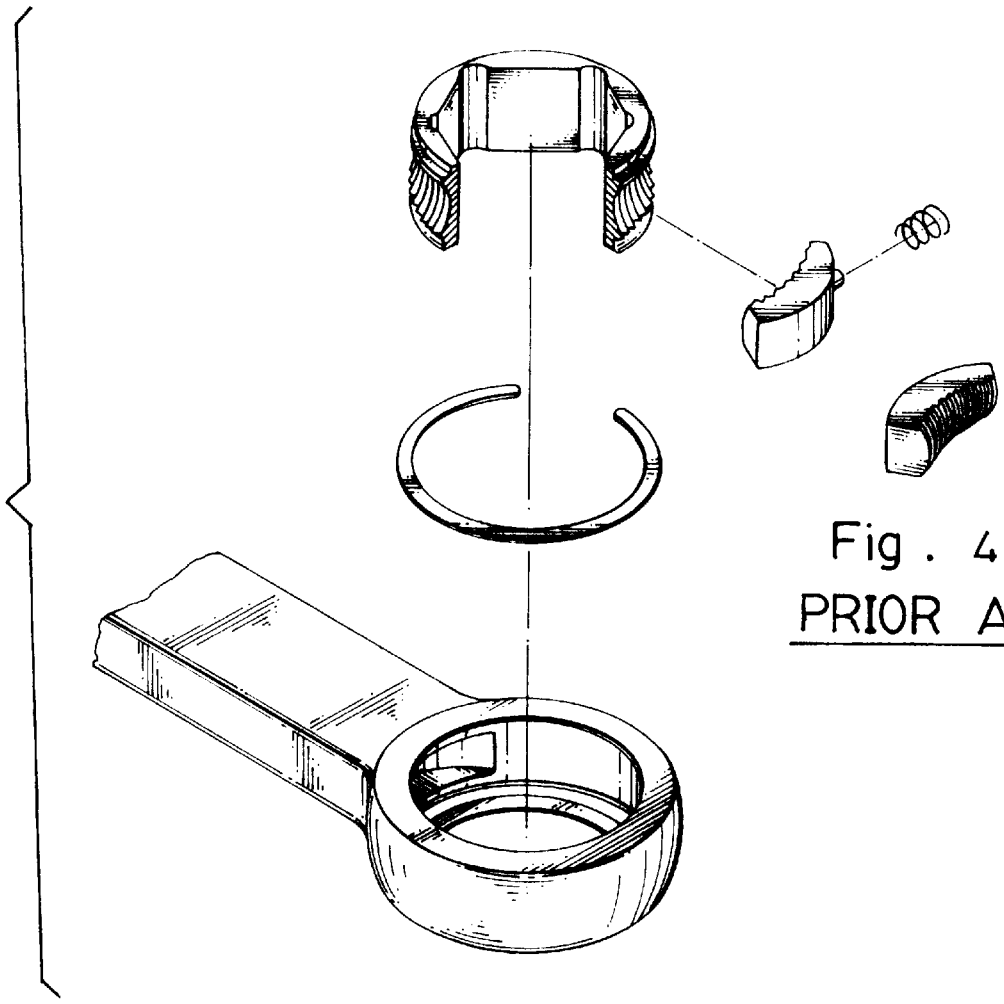
Fig. 4 PRIOR ART
Fig. 3 PRIOR ART
FIG. 3 is an exploded view of the arrangement shown in FIG. 1.
FIG. 4 is a perspective view of the tooth arch block shown in FIG. 3.
Figure 5:
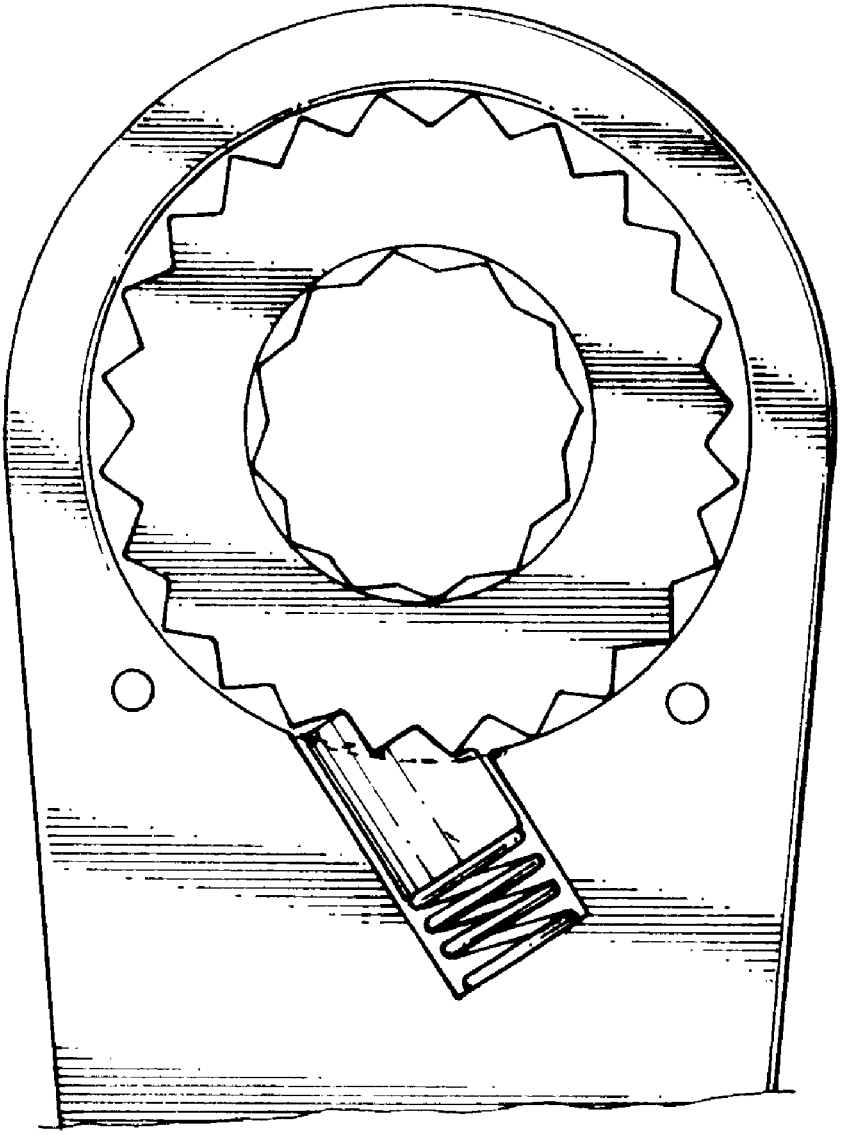
Fig. 5 PRIOR ART
FIG. 5 is a top plan view of another ratchet wheel mounting arrangement according to the prior art.
Figure 6:
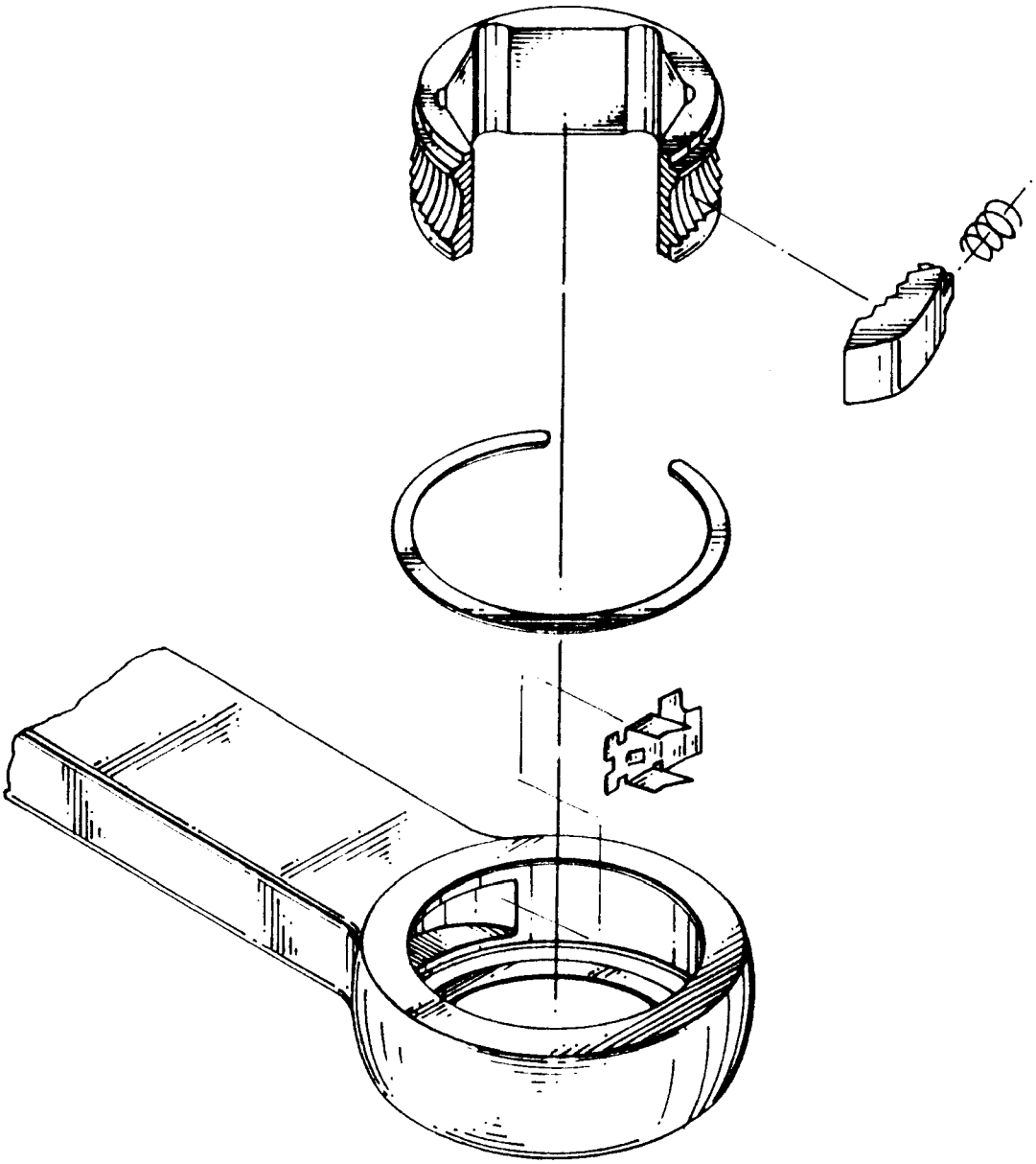
Fig. 6 PRIOR ART
FIG. 6 is an exploded view of the ratchet wheel mounting arrangement shown in FIG. 5.
Figure 7:
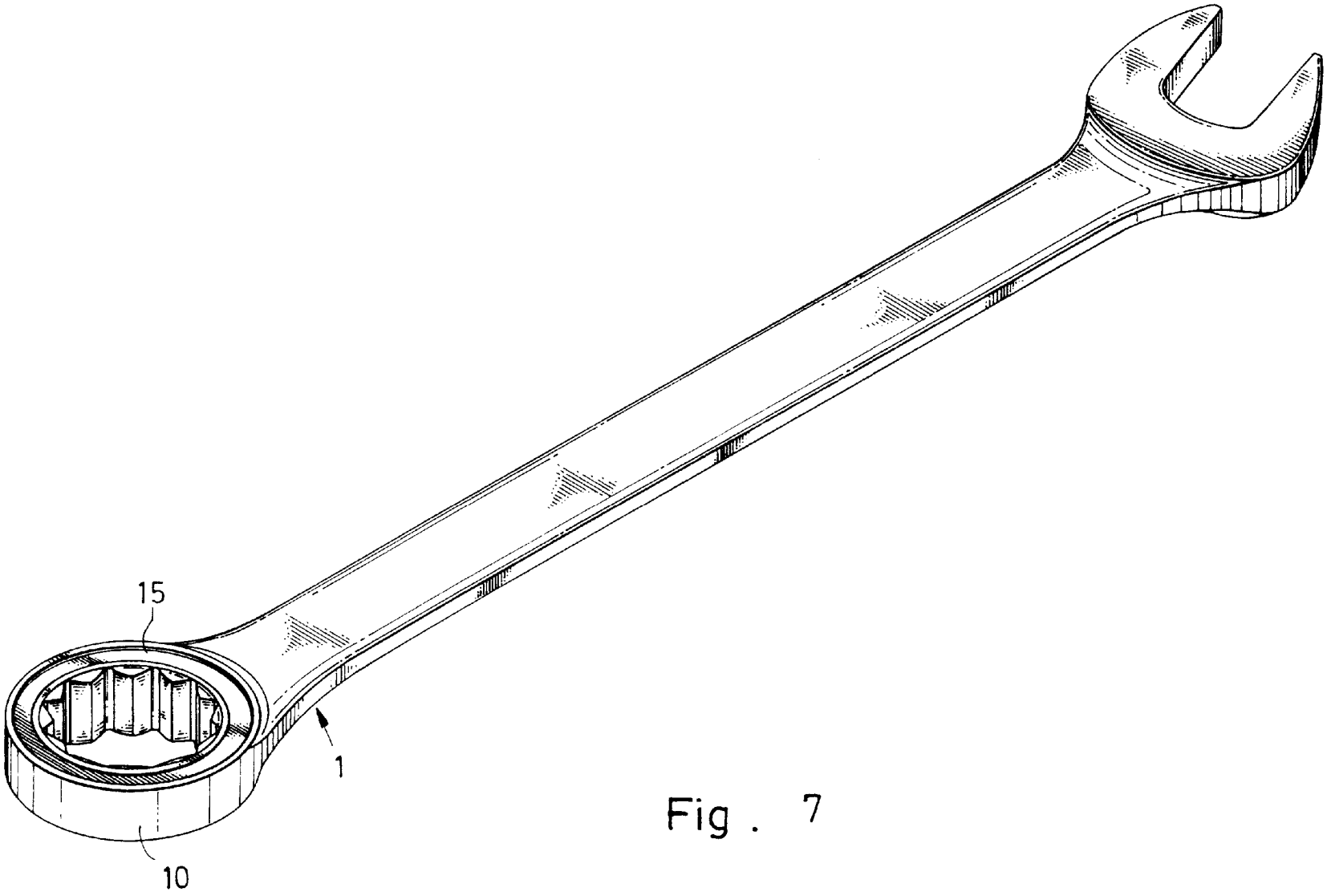
FIG. 7 is a perspective view of a wrench constructed according to the present invention.
Figure 8:
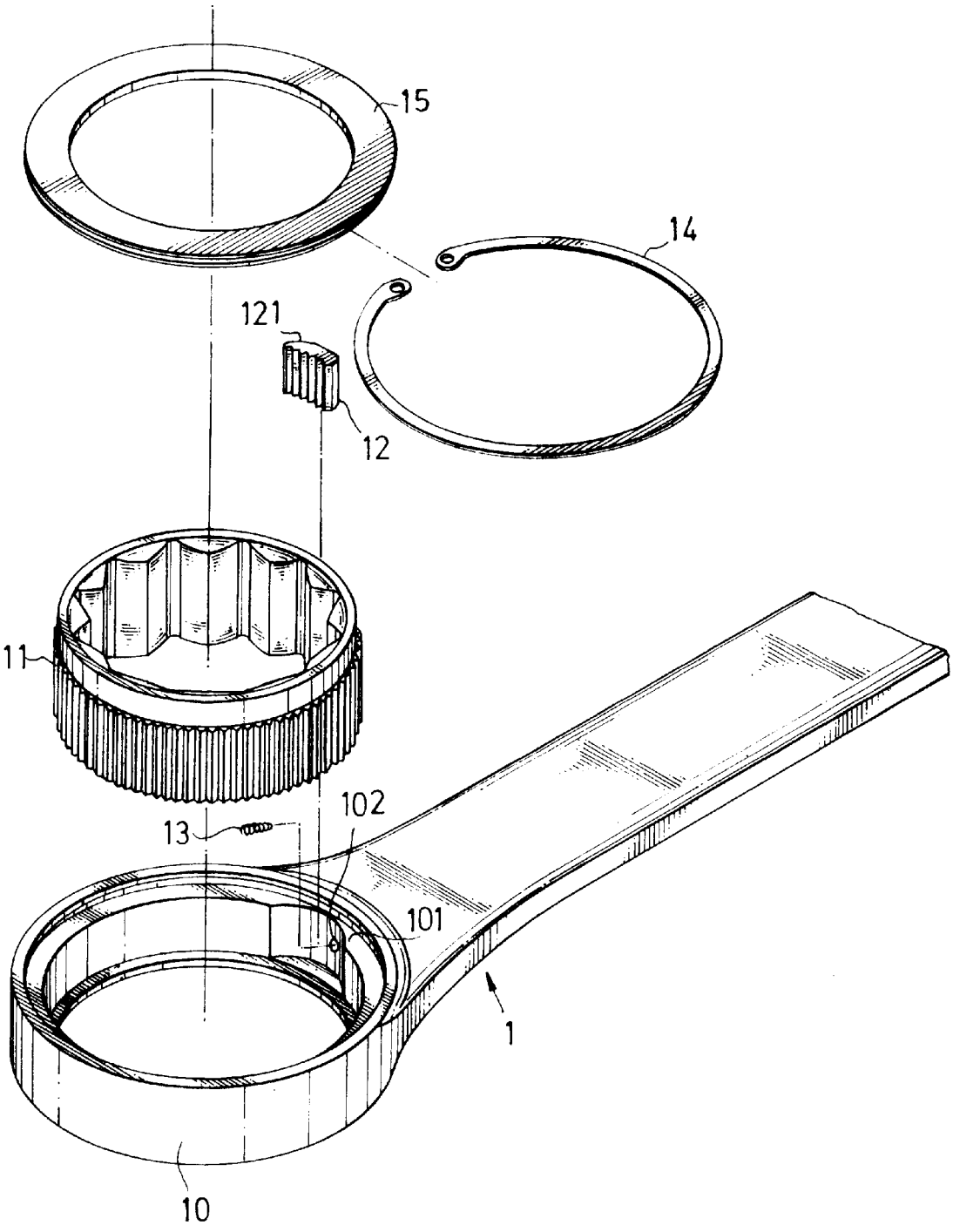
FIG. 8 is an exploded view in an enlarged scale of the ratchet wheel mounting arrangement of the wrench shown in FIG. 7.
Figure 9:
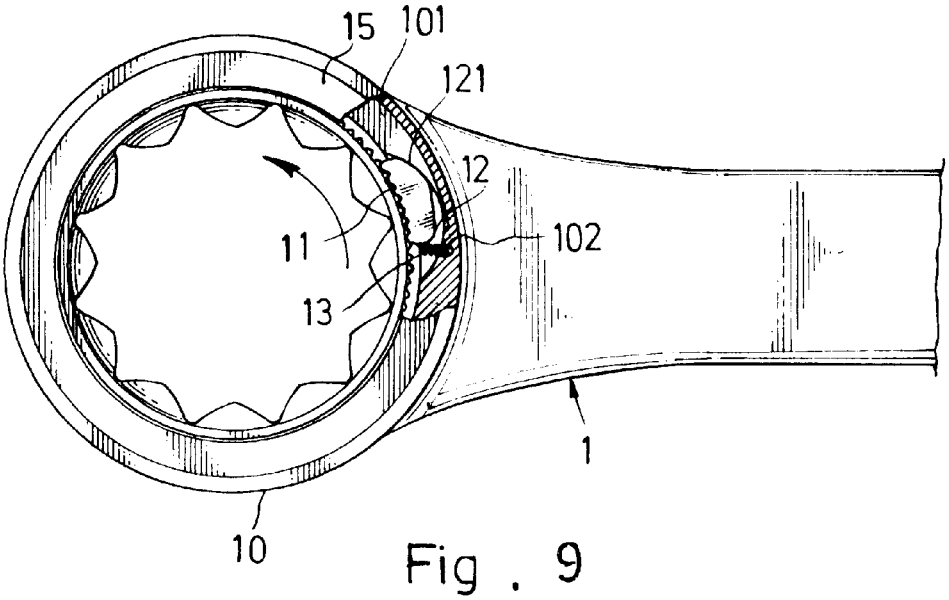
FIG. 9 is a sectional view of the ratchet wheel mounting arrangement according to the present invention, showing the ratchet wheel turned forward and force into engagement with the toothed arch block.
Figure 10:
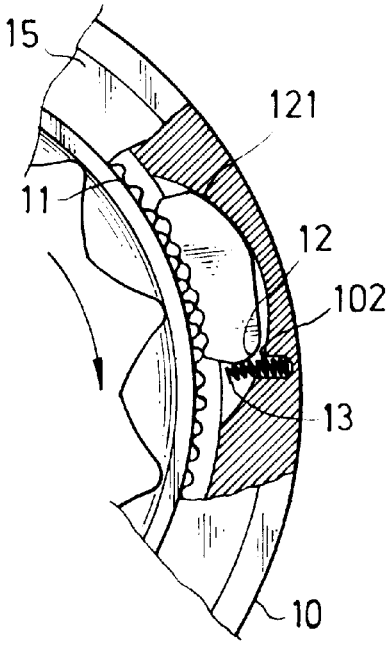
FIG. 10 is a sectional view in an enlarged scale of a part of the ratchet wheel mounting arrangement according to the present invention, showing the ratchet wheel turned backwards and disengaged from the toothed arch block.
Figure 11:
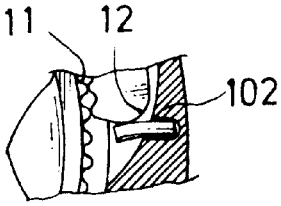
FIG. 11 is a sectional view of a part of FIG. 10, showing the spring mounted in the blind hole and connected to the toothed arch block.
Figure 12:
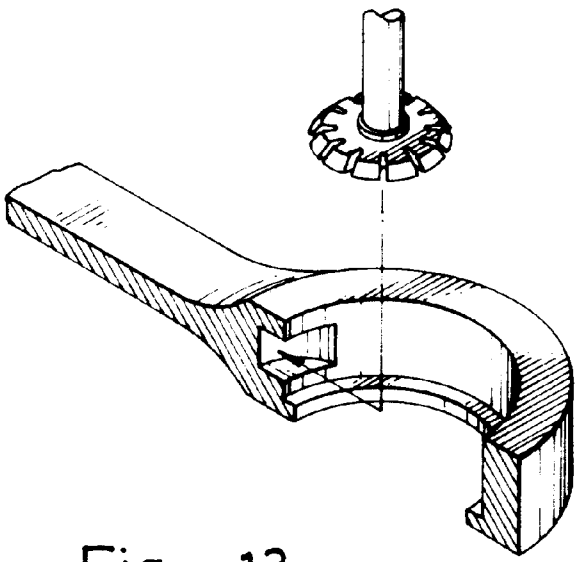
Fig. 12 PRIOR ART
FIG. 12 shows the processing of the recessed hole on the inside wall of the box end of the wrench according to the prior art.
Figure 13:
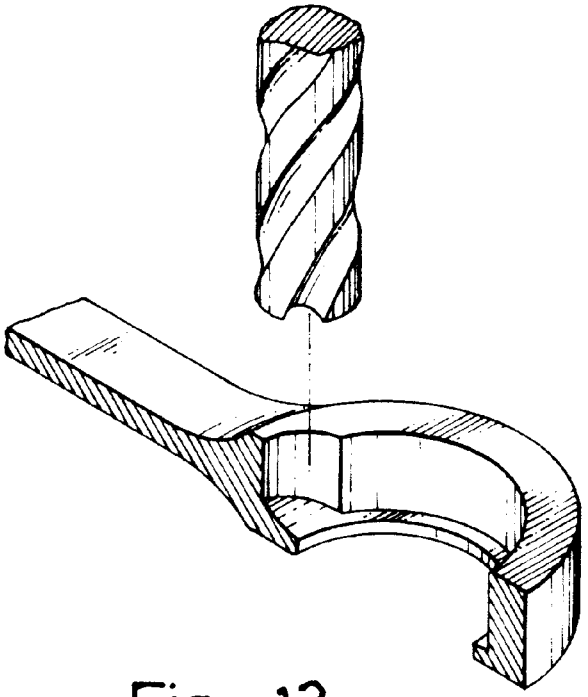
FIG. 13 shows the processing of the smoothly arched notch on the inside wall of the box end of the wrench according to the present invention.

Referring to FIG. 7, according to the present invention, a ratchet wrench 1 is shown having a handle section and an open end type head at one end of the handle section and a box-type end 10 at the other end. The box-type end 10 includes a circular peripheral wall defining a chamber therein for receiving a rachet wheel 11 therein. Referring to FIGS. 7 to 11, the ratchet wheel 11 is mounted within the inner surface of the box end 10 and secured in place by a C-shaped clamp 14. The box end 10 includes cover plate 15, a spring 13 mounted in the box end 10, the spring 13 having a first end and a second end and a toothed arch block 12 mounted within the box end 10 and operatively associated with the ratchet wheel 11. The arch block 12 is a biased or forced by the spring 13 into engagement with the ratchet wheel 11 to limit rotary motion of the ratchet wheel 11 to one direction. The arch block 12 has a curved back side and a toothed front side and is biased by the first end of the spring 13 into engagement with the ratchet wheel 11 in a radial direction relative to the circular peripheral wall to limit rotary motion of the ratchet wheel 11 to one direction. The arch block 12 has a predetermined transverse width dimension. The box end 10 of the wrench 1 has a smoothly arched notch 101 smoothly curved inwardly at the smooth inside wall thereof and is axially extended to the topmost edge of the smooth inside wall. The arched notch 101 has a shape match with that of the curved back side of the toothed arch block 12. The arched notch 101 is abuttingly received in the toothed arched block 12. A blind hole 102 at the smoothly arched notch 101 is spaced from one end of the smoothly arched notch 101 at a distance approximately ¼ of the width of the smoothly arched notch 101. The spring 13 has one end mounted in the blind hole 102, and an opposite end connected to one end of the toothed arch block 12. The toothed arch block 12 is mounted in the smoothly arched notch 101 inside the box end 10 and forced or biased by the spring 12 into engagement with the ratchet wheel 11 to limit the rotary motion of the ratchet wheel 11 in the box end 10 of the wrench 1 in one direction. A smoothly curved contact surface portion 121 disposed at the back side near one end remote from spring 13 and is forced into close contact with the surface of the smoothly arched notch 101. The opposite end of the toothed arch block 12 is biased by the smoothly arched notch 101 by the spring 13.

Figure 15:
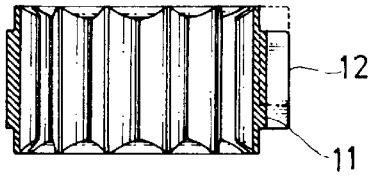
FIG. 15 shows the toothed arch block meshed with the ratchet wheel according to the present invention.
Figure 18:
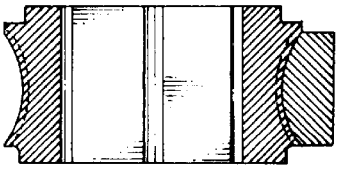
Fig. 18 PRIOR ART
FIG. 18 is a side view in section showing the toothed arch block engaged with the ratchet wheel according to the prior art.
Figure 17:
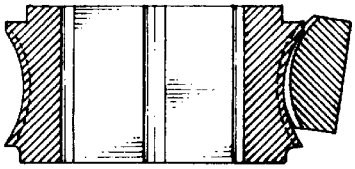
Fig. 17 PRIOR ART
FIG. 17 is a side view in section showing an abnormal engagement between the toothed arch block and the ratchet wheel according to the prior art.
Figure 14:
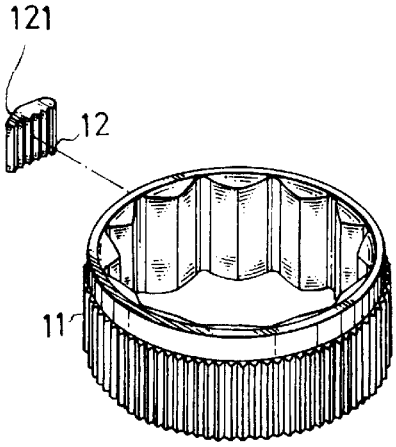
FIG. 14 is an exploded view of the ratchet wheel and the toothed arch block according to the present invention.
Figure 16:
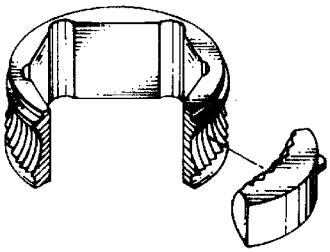
Fig. 16 PRIOR ART
FIG. 16 is an exploded view of the ratchet wheel and the toothed arch block according to the prior art.

Referring to FIGS. 14 and 15, the height of teeth of the toothed arch block 12 is approximately equal to the height of teeth of the ratchet wheel 11. When the toothed arch block 12 and the ratchet wheel 11 are meshed together, the ratchet wheel 11 is positively stopped from a forward rotation relative to the toothed arch block 12, and thereby turns in a reverse direction relative to the toothed arch block 12 and the box end 10 of the wrench 1.

I claim:

1. A ratchet wrench having a ratchet wheel mounting arrangement;

comprising:

a handle section and an open end type head at one end of said handle section and a box-type end at another end of said handle;

a rachet wheel having a plurality of ratchet teeth;

said box-type end includes an axis extending transversely to said handle section, a circular peripheral wall about said axis defining a chamber for receiving said rachet wheel therein; said circular peripheral wall having an inner surface and an outer surface, said inner and outer surfaces having top and bottom edges;

said ratchet wheel being secured within said chamber by a C-shaped clamp and a cover plate;

a spring mounted in said box end, said spring having a first end and a second end, said spring arranged radially relative to said axis of said box type end;

a toothed arch block mounted in said box end and operatively associated with said ratchet wheel;

said arch block having a curved back side and a toothed front side and being biased by said first end of said spring into engagement with said ratchet wheel in a radial direction relative to said wall for limiting rotary motion of said ratchet wheel within said chamber to one direction; said arch block having a predetermined transverse width dimension, and a height of teeth on said toothed front side of said arch block being approximately equal to a height of said ratchet teeth on said ratchet wheel;

an arched notch being smoothly curved inwardly from said inner surface of said circular peripheral wall and being axially extended to said top edge of said inside surface, said curved back side of said toothed arch block having a shape matching that of said arched notch and said arched notch receiving and abutting said curved back side of said toothed arch block; and a blind hole being disposed in said arched notch and being spaced from one end of said arched notch at a distance approximately ¼ of a transverse width dimension of said arched notch; said second end of said spring being mounted in said blink hole.

* * * * *